US008100733B1

(12) United States Patent
Ross et al.

(10) Patent No.: US 8,100,733 B1
(45) Date of Patent: Jan. 24, 2012

(54) PADDLE BLADE THAT ALLOWS USE OF A HANDLE AND/OR PADDLE FOR ANY WAY PADDLING

(76) Inventors: Gary Ross, Oxnard, CA (US); Bill Bragg, Oak View, CA (US); Miguel Munoz, Capistrano Beach, CA (US)

( * ) Notice: Subject to any disclaimer, the term of this patent is extended or adjusted under 35 U.S.C. 154(b) by 84 days.

(21) Appl. No.: 12/288,486

(22) Filed: Oct. 21, 2008

(51) Int. Cl.
*B63H 16/04* (2006.01)
*B63H 16/10* (2006.01)

(52) U.S. Cl. ..... 440/101

(58) Field of Classification Search ..... 440/101–110; 119/801
See application file for complete search history.

(56) References Cited

U.S. PATENT DOCUMENTS 3,039,120 A * 6/1962 Powell et al. ..... 416/63
D363,458 S * 10/1995 Killen ..... D12/215

* cited by examiner

*Primary Examiner* — Daniel Venne
(74) *Attorney, Agent, or Firm* — Thomas I. Rozsa

(57) ABSTRACT

The invention is the addition to traditional shafts used for stand-up paddling that normally have a standard paddle at one end of the shaft and a handle at the other end of the shaft. The invention incorporates a second paddle attached to the shaft at the location of the handle. The paddle may have an interior opening surrounding a portion of the handle to enable a user to grasp the handle with a user's hand. Alternatively, the body of the paddle can be oriented at an angle relative to the handle so that a gap is formed between an interior surface of the body of the paddle and the handle so that the handle can be grasped by a user's hand with the user's fingers resting in the gap.

8 Claims, 10 Drawing Sheets

PADDLE BLADE THAT ALLOWS USE OF A HANDLE AND/OR PADDLE FOR ANY WAY PADDLING

BACKGROUND OF THE INVENTION

1. Field of the Invention

The present invention relates to the field of standup paddling where a person stands on a surfboard and holds a shaft where a paddle at one end of the shaft is inserted into the water and the person grasps the shaft by a handle at the other end of the shaft so that the paddle can be stroked into the water to move the board along.

2. Description of the Prior Art

Over the last few years there has been a popularization of a sport whose origin can be traced back to the 1940's in Hawaii. The new sport is called standup paddling (SUP). A large very buoyant surfboard is used so the standing surfer can paddle while the board is in flat water. A single bladed paddle with a handle is used on a long shaft with a handle or a simple "T" at the other end. The typical blade of the single blade was discovered to work best if angled at about 14% relative to the shaft.

The surfer traditionally stands up and paddles with this long shafted single bladed paddle. The surfer paddles over flat water or also typically uses the single bladed paddle to paddle into and even catch and ride an ocean wave. Once the surfer catches a wave, the paddle is then actively used for maneuvering on the ocean wave for bracing and steering.

There are several reasons the sport has found new popularity as follows:

1. It provides great exercise and a great aerobic workout, strengthening a user's legs, arms, and chest;
2. It makes it easier to catch ocean waves;
3. It provides a convenient method for travel across any body of water;
4. It is highly enjoyable.

This is a difficult sport to learn especially with the single paddle but it is much easier than learning to surf on a surfboard with no paddle. It is hard to balance on the board at first to gain motion depending on the size of the surfer and the size of the board and made more difficult with conditions like wind or large waves that create different challenges to learning. However, after learning the basics of paddling, it is easier to catch a wave on the big board than a regular surfboard. This fact gives the sport immediate new popularity in open ocean areas as it makes it easier to catch a wave to surf.

There are many paddle sports and many sports that use a paddle that has either two blades on a shaft or a single blade on a shaft typically with a handle on the other end of the shaft if only one blade is used. Standup surfing uses a single blade as it is a long way down to the water when standing and the handle at the other end of the shaft is actively used for controlling the blade for paddling and for maneuvering while riding the waves. The standup surfer has to learn to switch the paddle from one side of the board to the other in order to go move in a generally straight line.

Beginners to the sport are sometimes seen sitting on a board using the paddle or on their knees on the board. The single paddle is not very efficient in this position, as the user must switch the paddle to the other side of the board so that the board goes generally in a straight line. Because the shaft is long, it is inefficient. In this position it functions like a bladed kayak paddle. If, for example, the surfer is in the ocean's environment where lots of waves are coming to shore, standing up can also be difficult so a kneeling position is used, even by experts. This is especially noticeable when the surfer is trying to get out past the active waves. A two-bladed paddle would be very efficient and much easier to use, especially for a beginning or intermediate level user. The problem with a two-bladed paddle is that it is not very efficient when paddling while standing. When you catch a wave, you need a handle to control the blade in the water for simple paddling or for surfing and the blade in the water is used as a steering or bracing option while riding an ocean wave.

SUMMARY OF THE INVENTION

The present invention is a unique paddle blade shape which can be easily attached to any standard standup paddle. A paddle blade can be rounded or square and is typically 9-10 inches wide and 9-12 inches long but can be any size. It has been discovered that if a hole were cut into the very center of this new blade, it would allow room to access and locate any standard paddle handle. It has been discovered that if the blade is constructed so that a structural element can be made from part of a shaft cut along its length, then this very structural shape can be nestled on the outside of the standard end of a standup paddle shaft. The shaft portion of the new paddle can be any length but needs to be no more than 12 inches long and can be attached with common stainless pipe clamps. This method secures the new blade structurally to the shaft of the standard standup paddle. This is a simple and structural way to attach this other blade to a standard paddle. It can also be attached by other means.

When attached, the typical ergonomic bulb-like handle will be located in the very center of the newly added blade. For safety a "U" shaped rubber molding can be added around this hand cutout hole and the "U" molding will protect the hand during active surfing and maneuvering.

It has been discovered that the hole for the hand in the middle of the blade does not cause any or very little power loss during paddling. This is because the combination of the generally typical concave inner surface of the blade which pushes water toward the center of the paddle at some angle and the edge of the molding helps to deflect that energy but also because the rounded handle in the very center of the hole keeps the blade efficient. The handle deflects the water force away from the opening in this unique blade. The combination of shapes creates a water flow that interferes with the water leaving the hole in the center and keeps the power of the blade efficient. In summary, the typical curved surface forces the water towards the center but at a slight angle and the handle deflects much of it back, thus preventing loss of power.

The main benefit of this "AWP" (any way paddle) blade is to be able to have the advantage of a second paddling blade like a kayak paddle for standup surfing without losing the utility of the single handle. The benefit of this design allows the user to paddle in the traditional standup manner with the traditional single blade. With the new AWP the user has the option of sitting on the board with the user's legs forward like a kayak or on the knees and using the two-bladed paddles more like a kayak paddle, or standing up and using the other end of the shaft to paddle instead of switching the one blade to the other side. This gives the user more options for convenience and safety while learning the sport. Expert standup surfers now paddle with their hands while going out through the waves because of the inefficiency of using the single paddle if the user is in the kneeling position. Paddling by hand is less efficient and slower. Two paddles are easier to use and would be used more like a kayak when getting through the waves and could make the difference between getting through the waves or not.

This new design can be a safety benefit as sitting down or leaning on the knees is easier and prevents fatigue and if offshore, it is much easier to paddle sitting on the board, especially in very windy or large swell conditions. It is almost impossible to stand up and paddle directly into the wind. This will give the user a safe alternative if the user is offshore and needs to get to a specific destination. It can also be used in the traditional standup method without the "extra" paddle getting in the way.

This design can easily be incorporated into a finished paddle design or as described here as an add-on for current paddles. Because this blade is relatively small, it can be stowed in a backpack to be used in an emergency to double the paddle power to make it back to shore. This could be a good safety option for offshore standup paddling. Currently there are competitions where users may travel many miles offshore and this would be appreciated if fatigue occurs or if adverse wind or swells create the need to more easily get to shore.

This design can be added to any current standard standup paddle as shown in the drawings. Alternatively, it is possible to incorporate a handle into this special blade and then attach this into the other end of a new paddle shaft. Because this paddle is very efficient, it is also reasonable to have one of these paddles on each side of a shaft giving more options for performance surfing. In this way the surfer has more options with respect to the blade and handle.

Most power paddle blades currently in use are at some angle. This angle can vary but it is usually 14 degrees although it can be within the range of 10 to 25 degrees, and it is most reasonable to add this angle into the design for a single blade or a fully integrated double bladed paddle with two handles and two blades. The angle blade is good for power strokes and an alternative of a straight non-angled paddle is good for turning the board or other maneuvers while still having the handle incorporated into the blade. It is a benefit of having two blade types for different functions. It is possible to have a larger power blade and a smaller blade that is easier to use when the board is stopped, like a lower gear. The addition of the other blade provides that functional option. The new design with a handle and with or without an angle gives more possibilities. In any case, whatever the choice of combination, the net result is two gears instead of one.

The concept of the present invention is to add the special angled blade around the handled end. This configuration provides more cosmetic and structural aspects in combination with the angled blade. This also provides the option of placing the handle in different positions and offers other options in terms of where any blade or blades are located on any shaft. Other options would be to offer just the blades and standard shafts for full adjustability. Currently, if a shaft breaks which is common, the paddle unit needs to be replaced with a new one. The new design of the current invention allows the user to simply replace the paddle. This also offers new more portable designs for easy travel and transport.

The concept of the present invention is to incorporate a paddle with a handle on at least one end of the shaft. The invention has two variations. In one variation, the paddle has an opening in the body of the paddle at the area which surrounds the handle on the shaft. The opening permits the user to place his/her hand over the handle and perform standup surfing. The second variation is to have a paddle which is oriented at an angle relative to the shaft and therefore also relative to the handle. The user then has room to place his/her hand over the handle and the user's fingers rest between the handle and the interior body of paddle in the space created by the angle. Therefore, the present invention encompasses the following alternative designs:

1. The shaft has a standard paddle at one end, a handle at the other end, and the present invention paddle with an opening in the paddle body is attached at the end with the handle so that there is room for a user's fingers to rest over the handle at the location of the opening in the present invention paddle.
   - 1.1 The present invention paddle is removably attached to the shaft so that it can be separately carried in a backpack and attached when in use.
   - 1.2 The present invention paddle is formed as part of the entire unit.
2. The shaft has a handle at each end and the present invention paddle with an opening in the paddle body is attached at each, with the shaft having the present invention paddles with the handles at each end so that there is room for a user's fingers to rest over the handle at the location of the opening in the present invention paddle and the shaft has a handle and the present invention paddle at each end.
   - 2.1 Both of the present invention paddles are removably attached to the shaft so that they can each be separately carried in a backpack and attached when in use.
   - 2.2 The present invention two paddles are formed as part of the entire unit.
3. The shaft has a standard paddle at one end, a handle at the other end, and the alternative present invention paddle has a solid body attached at the end with the handle so that the paddle is oriented at an angle relative to the shaft such as 14 degrees but it can be in the range of 14 to 25 degrees, so there is room for a user's fingers to rest over the handle and also between the handle and the alternative present invention paddle in the space provided by the area of the offset angle of the alternative present invention paddle.
   - 3.1 The alternative present invention paddle is removably attached to the shaft so that it can be separately carried in a backpack and attached when in use.
   - 3.2 The alternative present invention paddle is formed as part of the entire unit.
4. The shaft has a handle at each end and the alternative present invention paddle with a solid body attached at each end with a respective handle so that the paddle is oriented at an angle relative to the shaft, such as 14 degrees but it can be in the range of 10 to 25 degrees, so there is room for a user's fingers to rest over the handle and also between the handle and the alternative present invention paddle in the space provided by the area of the offset angle of the alternative present invention paddle.
   - 4.1 Both of the alternative present invention paddles are removably attached to the shaft so that they can each can be separately carried in a backpack and attached when in use.
   - 4.2 The alternative present invention two paddles are formed as part of the entire unit.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention incorporates a paddle at the location of a handle on a shaft so that so that it can be used as either a paddle or a handle depending on the desire of the surfer or standup surfer. Specifically, the present invention incorporates the following alternative embodiments:

The paddle with the handle will be formed into the shaft as an integral unit and can either be a shaft that has a paddle on one side and a paddle with a handle on the other side or a shaft that has a paddle with a handle on both sides. Alternatively, the shaft can be a solid cylindrical piece and a handle can be removable and the paddle can be removable and therefore attach onto the shaft either on one side to have a paddle with a handle on one side or attach onto both sides so there will be a paddle with a handle on both sides. Therefore, the variations are to either have a plain paddle and a second paddle with a handle or to have two paddles with each paddle having a handle. The handle and paddle can be formed into the shaft as an integral unit or the paddle can be removable from the shaft and stowed in a backpack and then attached to the shaft when the sport is to be performed.

In the present standup surfing sport, what is commercially available is a shaft that has a paddle at one end and a handle at the other end. The present invention incorporates a second paddle around the handle with one or two alternative variations, one of which has the paddle with an opening in it so the user's hand fits within the opening and it can be grasped that way or alternatively having the paddle recessed away from the handle so that the fingers can fit around the handle at a location between the handle and the paddle.

Currently, when users go to a store to buy a standup paddle they find a paddle at one end which is typically offset from being in line with the shaft and the handle itself is in line with the shaft at the other end. The present invention includes either a paddle which can also be in line with the shaft in which case it requires an opening in the paddle so your the user's hand can fit within it or alternatively, the paddle itself will not have an opening but will be offset from the handle so that the user can grasp the handle and there will be room for the user's fingers between the handle and the paddle.

Figure 1:
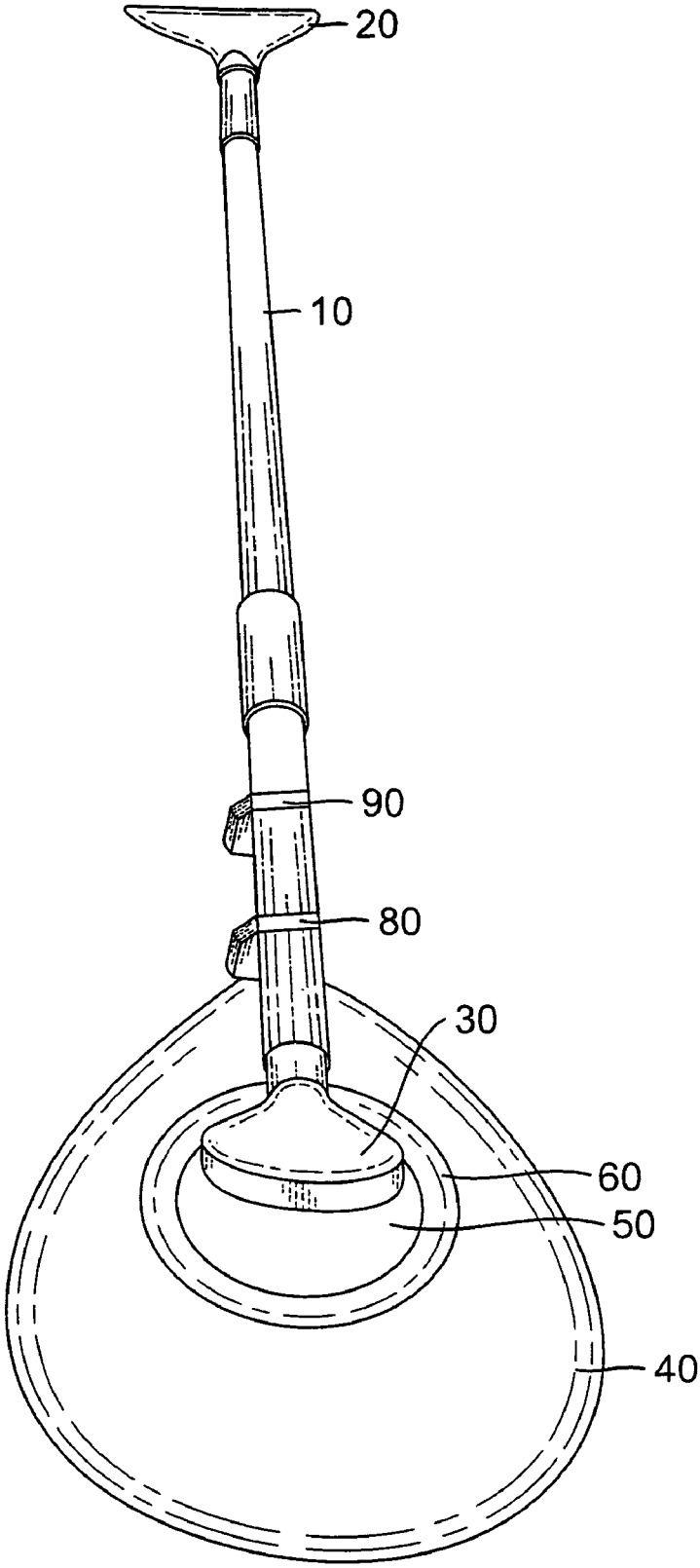
FIG. 1 is a perspective view of a standard shaft with a standard paddle at one end of the shaft and a handle at the other end of the shaft, with a first embodiment of the present invention paddle attached to the shaft at the location of the handle.
Figure 2:
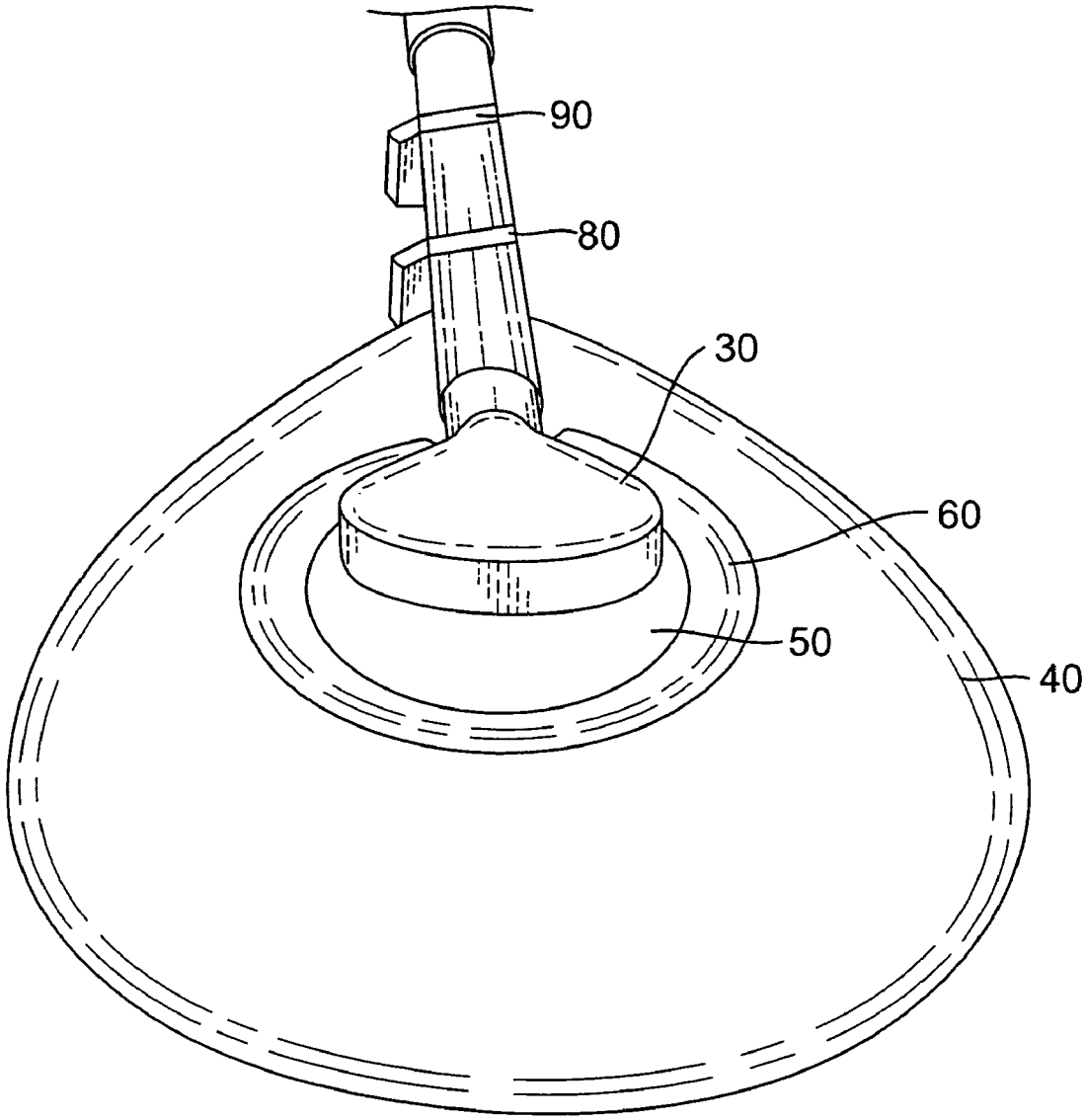
FIG. 2 is a close-up perspective view of the first embodiment of the present invention paddle attached to the shaft at the location of the handle.
Figure 3:
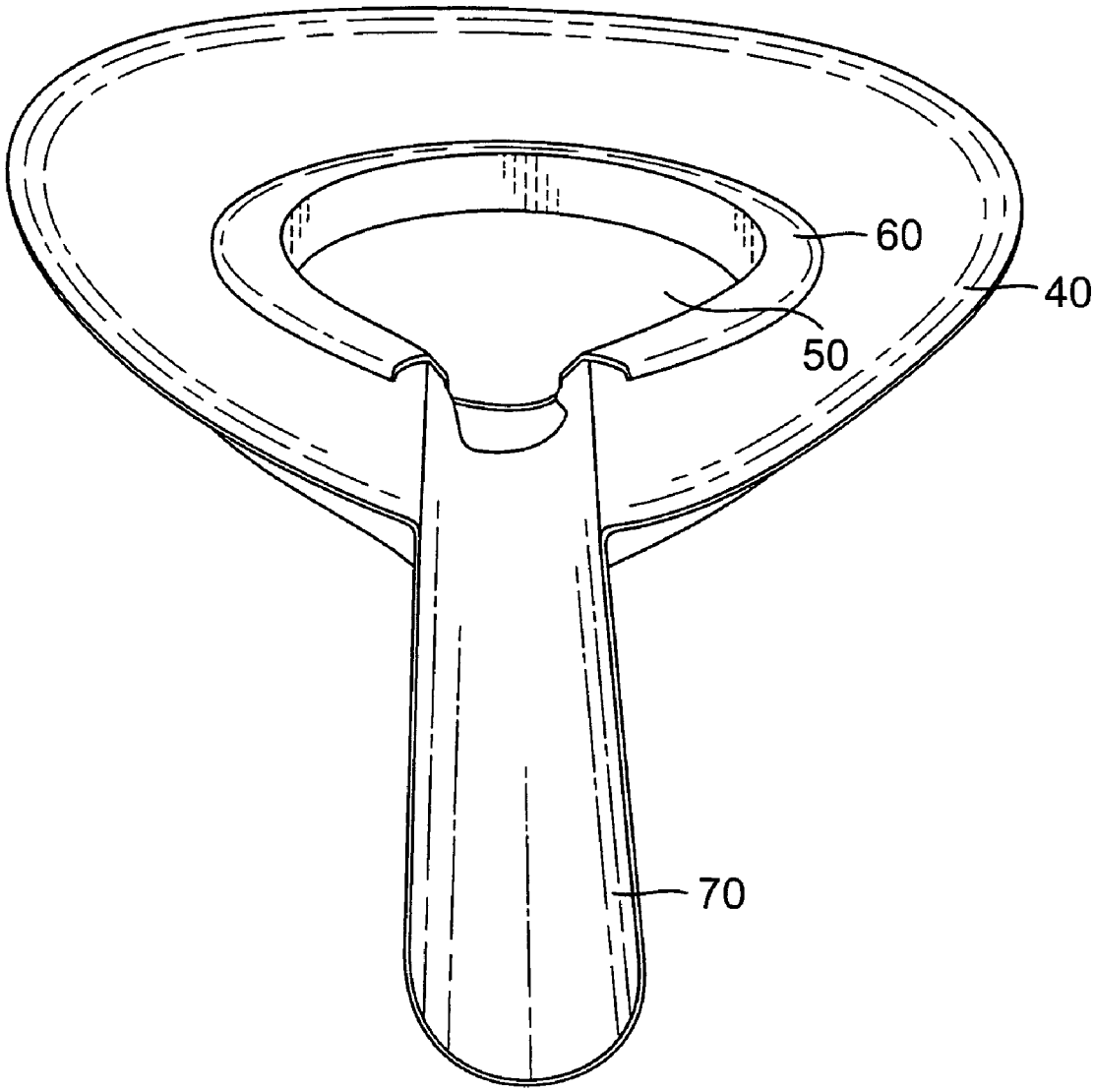
FIG. 3 is a perspective view of the first embodiment of the present invention paddle illustrating a semi-open shaft mating member on the paddle.

Referring to FIG. 1, there is a closeup view of one alternative embodiment of the present invention. Referring to FIG. 2, the entire embodiment is disclosed. Specifically, there is a shaft 10 and on one end of the shaft is a paddle 20 which is a conventional paddle that is typically offset from the shaft 10 at a certain angle. At the other end of the shaft 10 is a handle 30. This is typically the way a standup paddle is formed. The present invention in the first embodiment is to include a second paddle 40 with an open recess 50 and preferably a molding or barrier 60 so that there is a cushioning between a person's hand when the person grasps the handle 30 and they will not be cut by the interior of the newly added paddle 40. The paddle can be affixed to the shaft by means such as hose clamps 80 and 90. This is just one method by which the paddle can be attached to the shaft. Referring to FIG. 3, the present invention paddle 40 and its opening 50 is shown having a elongated semi-open shaft mating member 70 which is used to clamp onto the shaft 10 by hose clamps 80 and 90. It will be appreciated that this is only one affixation means. Basically, this is one method by which the paddle can be attached. It will be appreciated that any method which permits the paddle to be clamped onto the end of the shaft is within the spirit and scope of the present invention. Therefore, through use of this embodiment, the present standup paddle is modified by having a second paddle attached to the end with a handle with an opening so that a person's hand can fit over the handle and within the opening so that the person can use the paddle and the handle for standup paddling. An example of this is shown in FIG. 4 where the paddle is in the water and the person is grasping the handle with his other hand inside the opening of the paddle.

Figure 4:
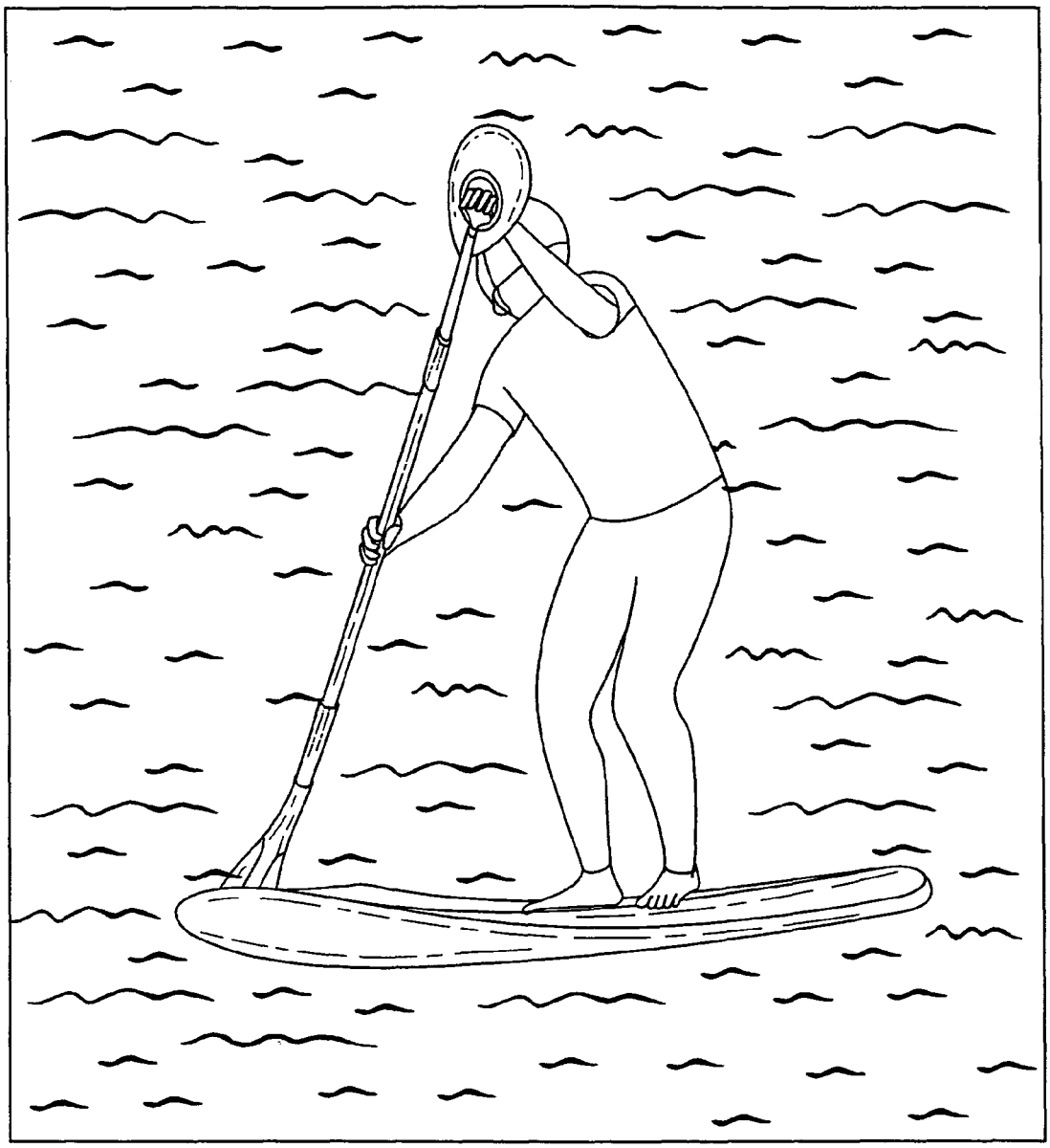
FIG. 4 is an illustration showing a person performing stand-up paddling with the first embodiment present invention paddle on a shaft.
Figure 5:
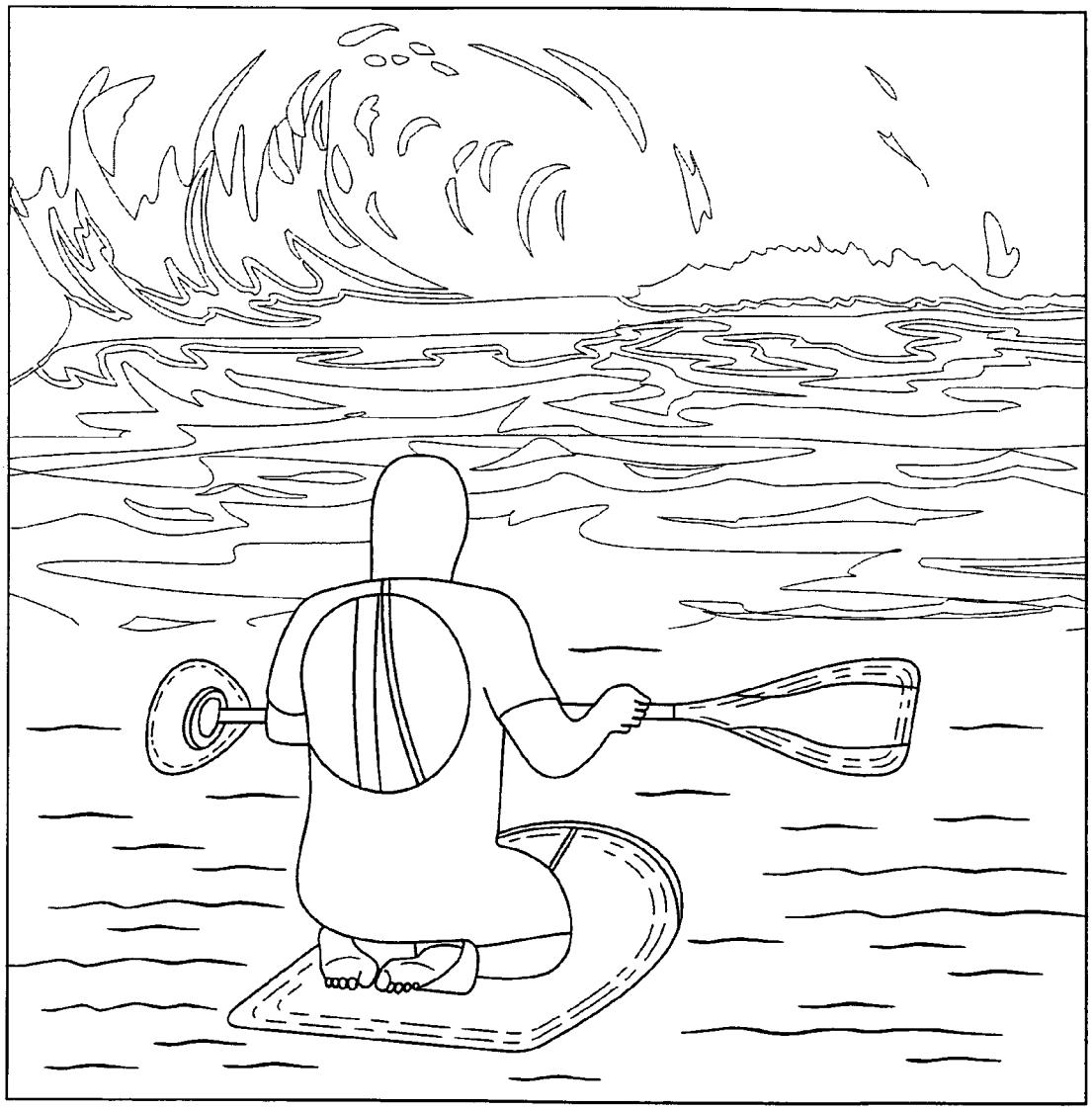
FIG. 5 is an illustration of a person sitting on a board in water with the present invention used in paddling.
Figure 6:
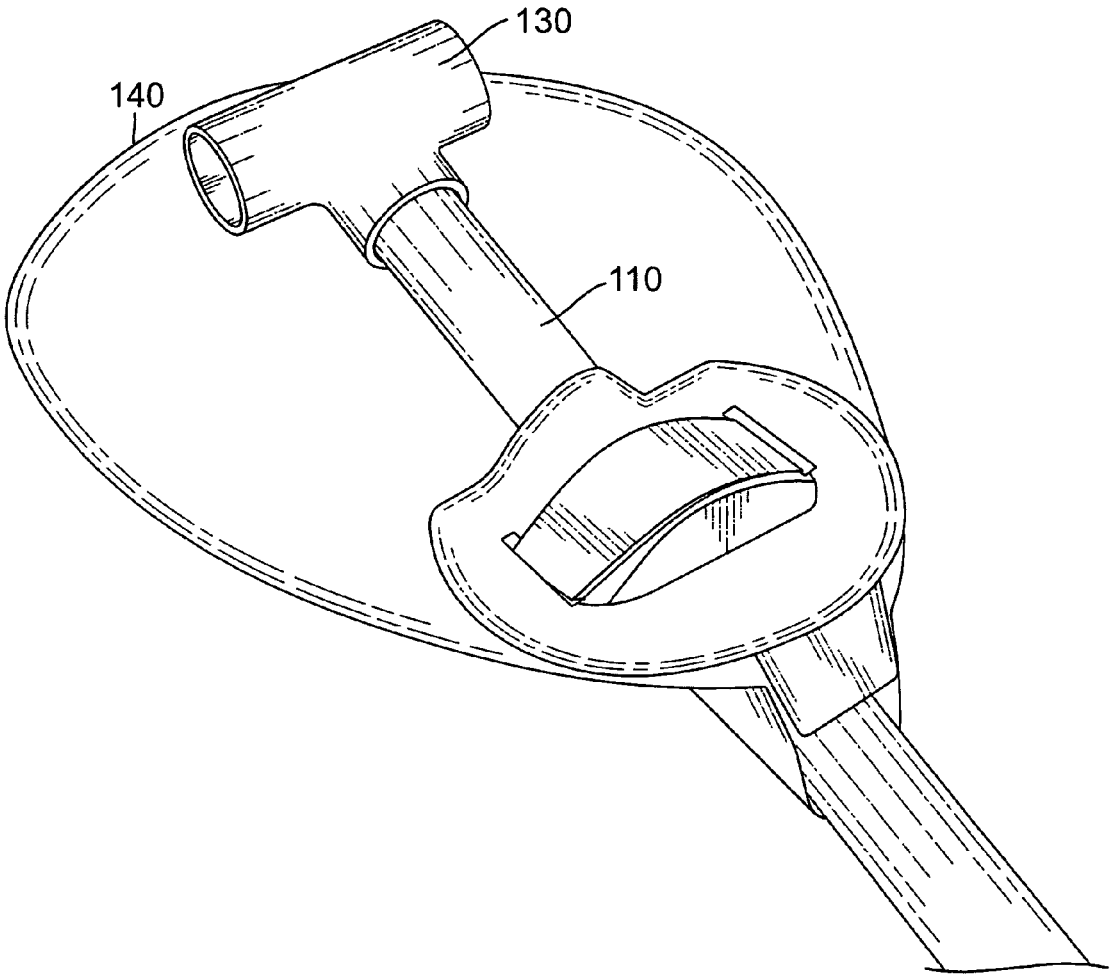
FIG. 6 is an interior perspective view of a portion of a standard shaft with a handle at one end, with a second or alternative embodiment of the present invention paddle attached to the shaft at the location of the handle.
Figure 7:
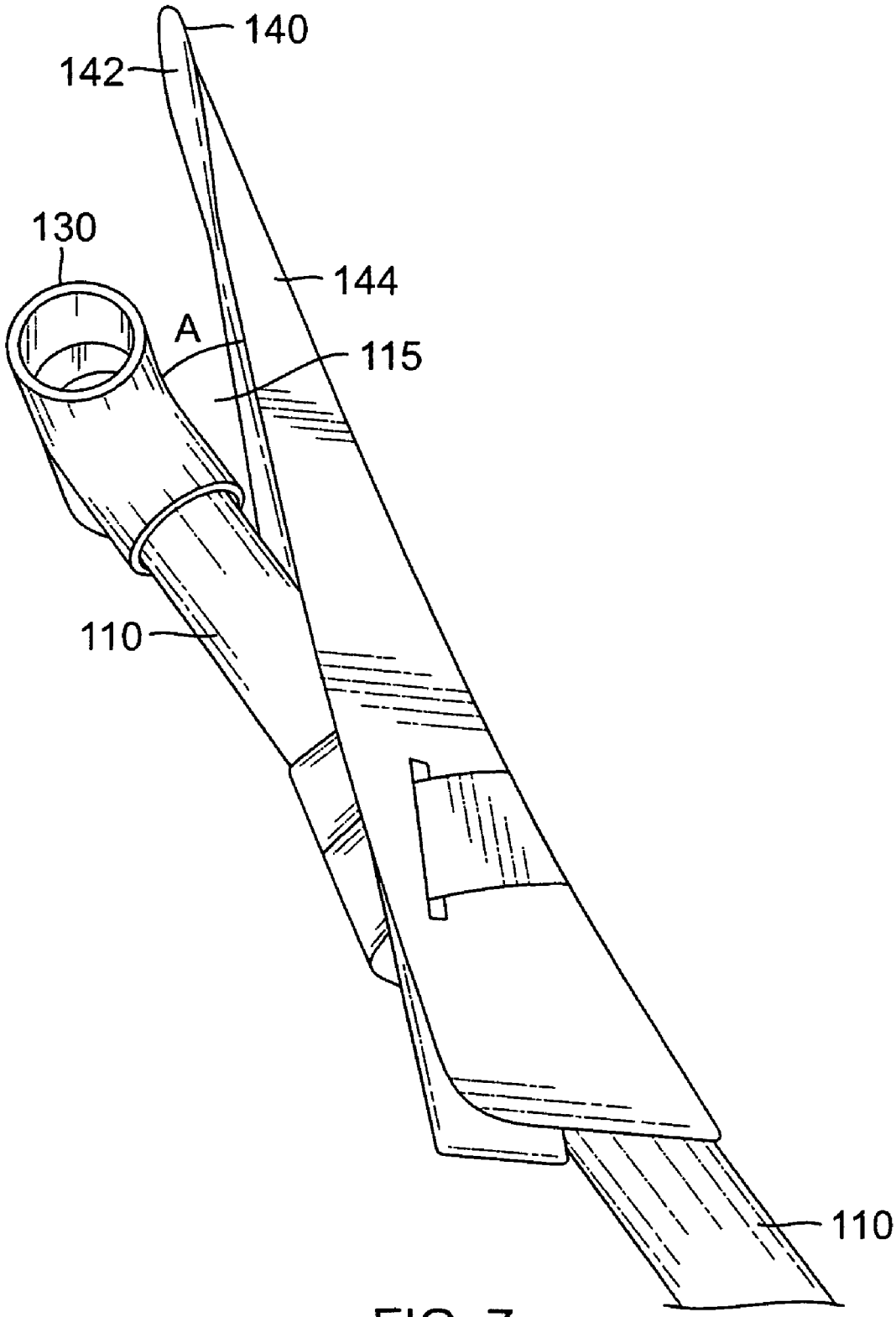
FIG. 7 is a side elevational view of a portion of a standard shaft with a handle at one end, with the second or alternative embodiment of the present invention paddle attached to the shaft at the location of the handle.
Figure 8:
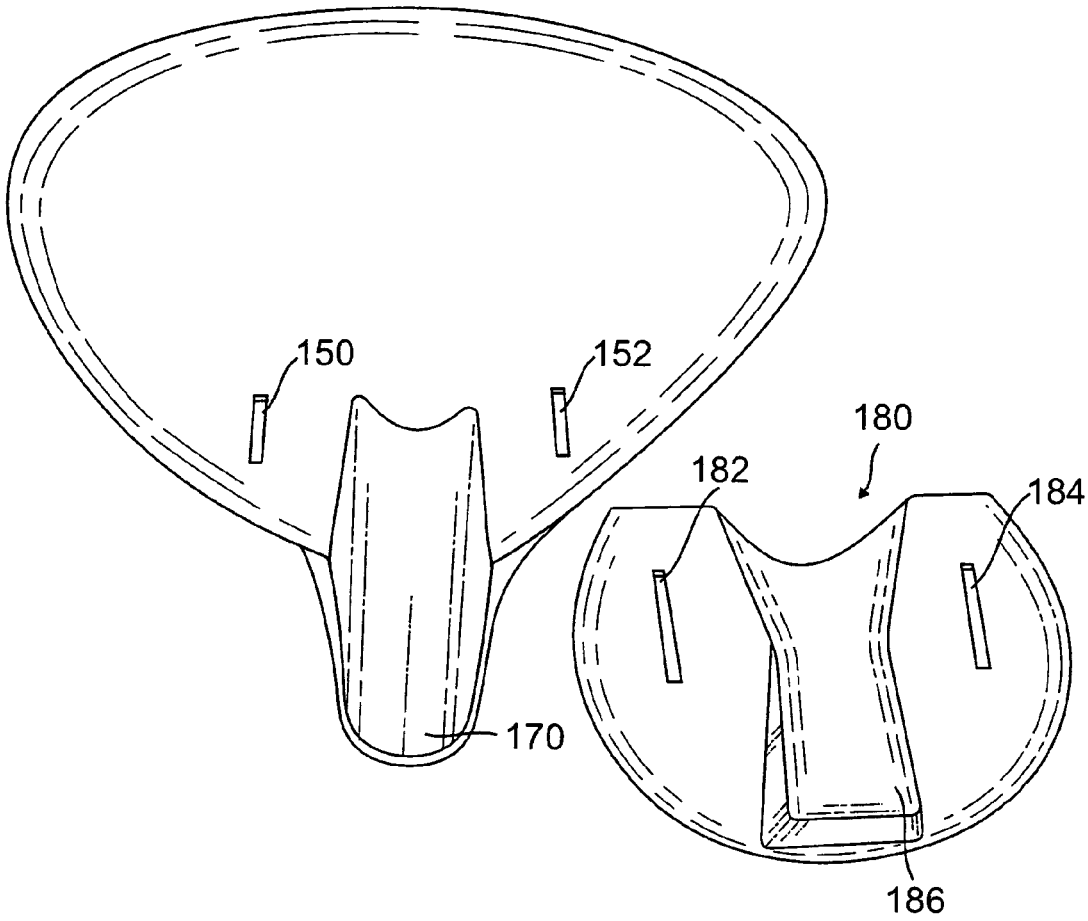
FIG. 8 is an open view of the mating shaft receiving member on the paddle and the mating collar used to attach the second alternative embodiment of the present invention paddle to a shaft.
Figure 9:
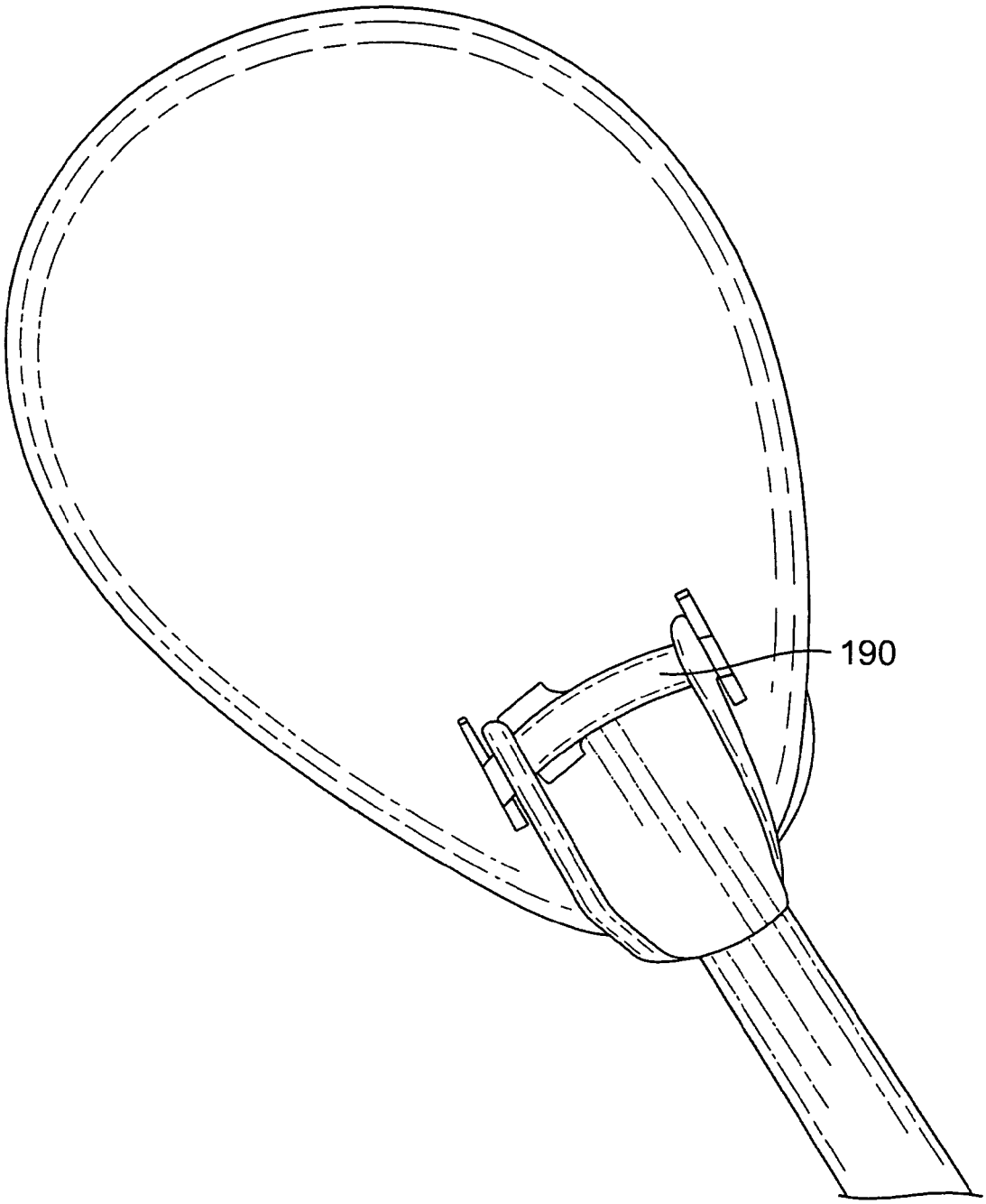
FIG. 9 is an exterior perspective view of a portion of a standard shaft with a handle (not shown) at one end, with a second or alternative embodiment of the present invention paddle attached to the shaft at the location of the handle.
Figure 10:
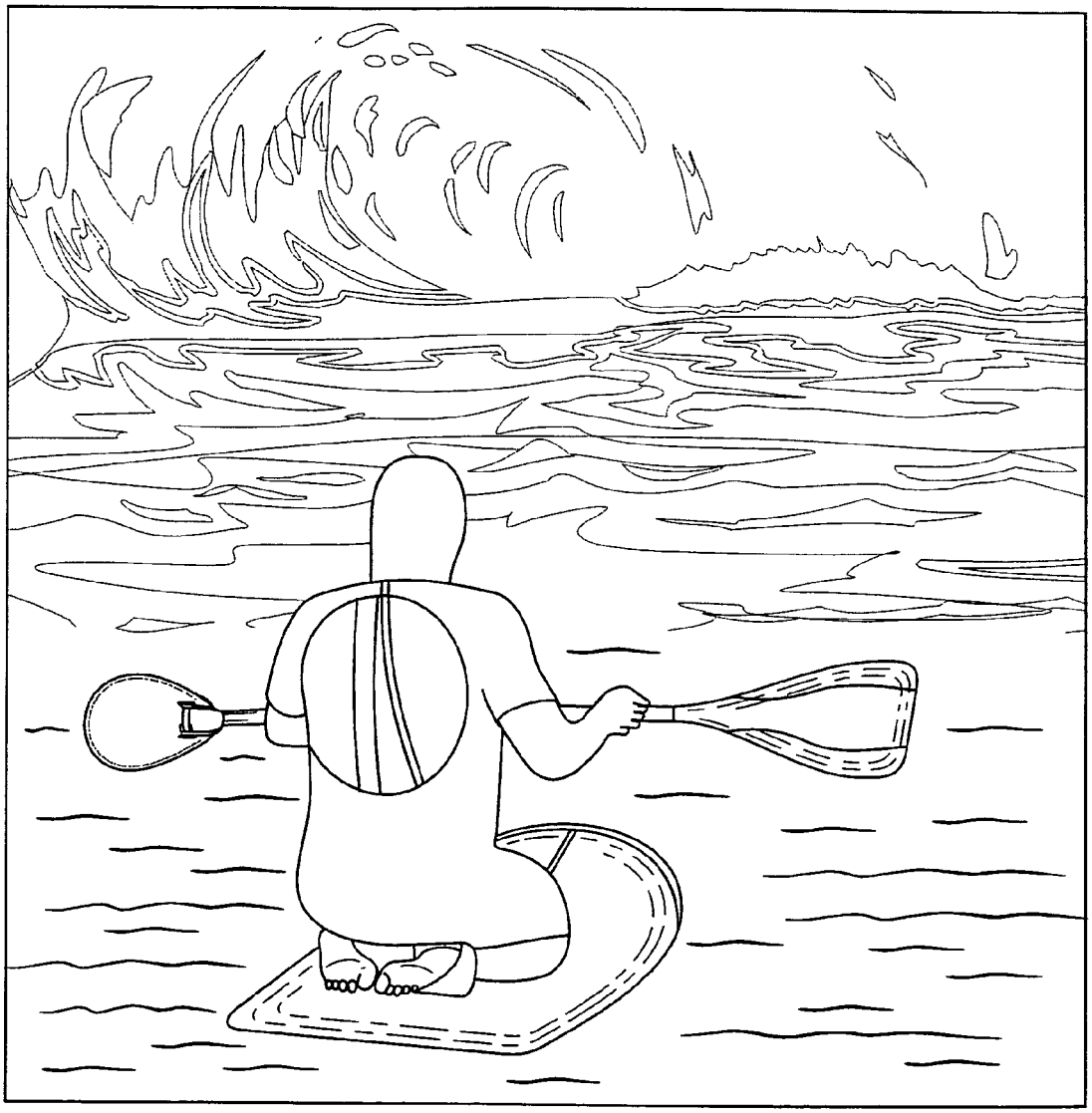
FIG. 10 is an illustration of a person sitting on board in water with the present invention utilizing the alternative embodiment of the present invention used in paddling.

The present invention therefore permits this device to be used as a dual paddle as illustrated in FIG. 5 so that a person can be sitting on the board and paddling in an ordinary manner and alternatively can be engaged in a standup paddling exercise where one end of the paddle is in the water and the paddle with the handle is raised above so the person is standing on the board and basically stroking the water by grasping the handle as illustrated in FIG. 4.

Alternatively, it will be appreciated that it is within the spirit and scope of the present invention to have the handle on both sides of the shaft. In this case, this would have to be custom manufactured because what is available in stores is traditionally just a paddle on one side and a handle on the other. Therefore, in order to have a paddle with a handle on both sides, it would require just a shaft with a handle on each end and the paddle inserted on both ends of the shaft of the present invention.

An alternative embodiment to the present invention is illustrated in FIGS. 6 through 9. In this embodiment, there is not an opening recess in the paddle and the paddle itself 140 is a solid member. Therefore, in order to accommodate the fingers of the hand around the handle 130, it is necessary to have the paddle 140 offset at an angle from the shaft 110 and handle 130 so that a person's fingers can fit around the handle 130 and at the same time there is room for the person's fingers between the handle and the interior of the paddle 142.

The second embodiment which is shown in FIGS. 6 through 9 essentially has a shaft 110 and takes advantage of current designs of paddles 140 where the paddles 140 are offset relative to the shaft 110 by a certain angle "A" which by way of example only can be 14 degrees but it can also be in the range of 10 to 25 degrees. The present invention is to cut two slits into the paddle on either side of the elongated semi-open shaft mating member 170 into which the shaft 110 will fit and then have a mating collar 150 which also has a pair of slits 182 and 184 that respectively align with the slits 150 and 152 in the paddle and a mating section 186 which fits over the shaft 100 and then have a fastening mechanism 190 such as a velcro strap by which the paddle 140 handle is retained on the shaft 110. The paddle 140 has an interior surface 142 facing the handle 130 and an exterior surface 144. It will be appreciated that mating velcro straps are just one embodiment and a belt or any other fastening mechanism 190 that fastens the collar 180 and paddle 140 onto the shaft 110 so that the shaft 110 is retained between the collar 180 and the paddle 140 is within the spirit and scope of the present invention. There is no opening to accommodate a user's hand in the paddle 140 but in this embodiment the difference is that the paddle 140 is offset relative to the shaft 110 so that there is a gap 115 between the handle 130 and the interior 142 of the paddle 140 so that a person can grasp the handle 130 with their fingers and basically have their fingers between the handle 130 and the paddle 140 as they operate the device. Once again, this alternative embodiment can be incorporated into the present invention standup paddle where you are basically having a paddle with the new improved invention inserted around the area where the standup paddle has the handle. Alternatively, if it is desired to have a handle with a paddle on both ends of the shaft, then it would start with a basic shaft and then the present invention paddle is affixed around the handle in the manner described above on both ends of the shaft to provide a paddle on both ends with a handle on both ends. Therefore, the present invention would include either having a standard paddle at one end and then a paddle with a handle at the other end or having a paddle with a handle at both ends. The present invention also envisions having the entire apparatus formed into the shaft itself rather than having the paddle removable or alternatively, has the embodiment of having the paddle removably attached to the shaft so that the paddle can be stowed in a backpack or other carrying device and then the paddle inserted onto the end of the shaft when it is desired to use the paddle for the sport of standup paddling.

The present invention is a shaft having two ends with a standard paddle at one end and a handle at the other end, the present invention comprising: a paddle attached to the shaft at the location of the handle, the paddle having a body extending around the handle and the body of the paddle containing an interior opening around a portion of the handle to enable the handle to be grasped.

Alternatively, the present invention is a shaft having two ends with a standard paddle at one end and a handle at the other end, the present invention comprising: a paddle attached to the shaft at the location of the handle, the paddle having a body oriented at an angle relative to the shaft and handle to form a gap between an interior surface of the paddle body and the handle to thereby enable the handle to be grasped.

Also alternatively, the present invention is a shaft comprising: (a) the shaft having two ends with a first handle at one end and a second handle at the opposite end; (b) a first paddle attached the shaft at the location of the first handle, the first paddle having a body extending around the first handle and the body of the first paddle containing an interior opening around a portion of the first handle to enable the first handle to be grasped; and (c) a second paddle attached the shaft at the location of the second handle, the second paddle having a body extending around the second handle and the body of the second paddle containing an interior opening around a portion of the second handle to enable the second handle to be grasped.

Additionally alternatively, the present invention is a shaft comprising: (a) the shaft having two ends with a first handle at one end and a second handle at the opposite end; (b) a first paddle attached the shaft at the location of the first handle, the first paddle having a body oriented at an angle relative to the shaft and first handle to form a gap between an interior surface of the first paddle body and the first handle to thereby enable the first handle to be grasped; and (c) a second paddle attached the shaft at the location of the second handle, the second paddle having a body oriented at an angle relative to the shaft and second handle to form a gap between an interior surface of the second paddle body and the second handle to thereby enable the second handle to be grasped.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A shaft comprising:

a. the shaft having two ends with a first handle at a first end of the shaft and a second handle located at a second end of the shaft;

b. a first paddle attached the shaft at the location of the first handle, the first paddle having a body extending around the first handle and the body of the first paddle containing an interior opening around a portion of the first handle to enable the first handle to be grasped; and c. a second paddle attached the shaft at the location of the second handle, the second paddle having a body extending around the second handle and the body of the second paddle containing an interior opening around a portion of the second handle to enable the second handle to be grasped.

2. The invention in accordance with claim 1 wherein each paddle is removably attached to the shaft.

3. The invention in accordance with claim 2 wherein each paddle is permanently attached to the shaft.

4. The invention in accordance with claim 2 further comprising a first cushioning member on the body of the first paddle at the location of the interior opening and a second cushion member on the body of the second paddle at the location of the interior opening.

5. A shaft comprising:

a. the shaft having two ends with a first handle at a first end of the shaft and a second handle located at a second end of the shaft;

b. a first paddle attached to the shaft at the location of the first handle, the first paddle having a body oriented at an angle relative to the shaft and first handle to form a gap between an interior surface of the first paddle body and the first handle to thereby enable the first handle to be grasped; and c. a second paddle attached to the shaft at the location of the second handle, the second paddle having a body oriented at an angle relative to the shaft and second handle to form a gap between an interior surface of the second paddle body and the second handle to thereby enable the second handle to be grasped.

6. The invention in accordance with claim 5 wherein the angle of the first paddle body relative to the first handle is in the range of 10 degrees to 25 degrees and the angle of the second paddle body relative to the second handle is in the range of 10 degrees to 25 degrees.

7. The invention in accordance with claim 5 wherein the first paddle is removably attached to the shaft and the second paddle is removably attached to the shaft.

8. The invention in accordance with claim 5 wherein the first paddle is permanently attached to the shaft and the second paddle is permanently attached to the shaft.

* * * * *